United States Patent [19]

Marshall

[11] 4,317,736

[45] Mar. 2, 1982

[54] SOIL RESISTANT YARN FINISH FOR SYNTHETIC ORGANIC POLYMER YARN

[75] Inventor: Robert M. Marshall, Chester, Va.

[73] Assignee: Allied Chemical Corporation, Morris County, N.J.

[21] Appl. No.: 210,995

[22] Filed: Nov. 28, 1980

[51] Int. Cl.[3] ..... D06M 13/34

[52] U.S. Cl. ..... 252/8.75; 428/395; 252/8.7; 252/8.8

[58] Field of Search ..... 252/8.7, 8.75, 8.8

[56] References Cited

U.S. PATENT DOCUMENTS

| | | | |
|---|---|---|---|
| 4,134,839 | 1/1979 | Marshall et al. | 252/8.6 |
| 4,190,545 | 2/1980 | Marshall et al. | 252/8.8 |
| 4,192,754 | 3/1980 | Marshall et al. | 252/8.8 |
| 4,193,880 | 3/1980 | Marshall | 252/8.7 |
| 4,209,610 | 6/1980 | Mares et al. | 8/115.5 |

*Primary Examiner*—Maria Parrish Tungol

*Attorney, Agent, or Firm*—Virginia S. Andrews

[57] ABSTRACT

A yarn finish composition is disclosed for incorporation with synthetic organic polymer yarn or yarn products to render the same oil repellent and resistant to soiling. The composition comprises (a) a solution of a salt of dioctyl sulfosuccinate, propylene glycol and water, (b) a fluorochemical compound consisting of polycarboxybenzene esterified with certain partially fluorinated alcohols and with hydroxyl-containing organic radicals such as 2-hydroxyethyl, glyceryl, and chlorohydryl or bromohydryl, and (c) a dispersant selected from the group consisting of a salt of a polycarboxylic acid, a salt of a sulfonated naphthalene-formaldehyde condensate, and a salt of an alkyl naphthalene sulfonate.

68 Claims, No Drawings

SOIL RESISTANT YARN FINISH FOR SYNTHETIC ORGANIC POLYMER YARN

BACKGROUND OF THE INVENTION

1. Field of the Invention

This invention relates to a yarn finish composition. More particularly, this invention relates to a yarn finish composition for incorporation with synthetic organic polymer yarn or yarn products to render the same oil repellent and resistant to soiling. This invention further relates to emulsion and spin finishes which include the aforementioned yarn finish composition as a component thereof.

2. Description of the Prior Art

The treatment of textiles with fluorochemicals to impart oil repellency and soil resistance has been known for some time. See the discussion in U.S. Pat. No. 4,134,839 to Marshall, U.S. Pat. No. 4,192,754 to Marshall et al. and U.S. Pat. No. 4,209,610 to Mares et al., all of which are hereby incorporated by reference, and U.S. Application Ser. No. 102,588 filed Dec. 12, 1979. The spin finishes described in the referenced application and U.S. Pat. No. 4,192,754 to Marshall et al. unfortunately cause fluorocarbon deposits in the finish feed lines. Therefore, research has been carried out to develop an improved spin finish which possesses the desirable properties of the aforementioned references and which will not cause fluorocarbon deposits in the finish feed lines.

SUMMARY OF THE INVENTION

The present invention provides a yarn finish composition for incorporation with synthetic organic polymer yarn or yarn products to render the same oil repellent and resistant to soiling.

The yarn finish composition of the present invention comprises (a) about 15 to 80 weight percent of a solution of a salt of dioctylsulfosuccinate, propylene glycol and water; (b) about 20 to 85 weight percent of a fluorochemical compound, and (c) an effective amount of a dispersant selected from the group consisting of a salt of a polycarboxylic acid, a salt of a sulfonated naphthaleneformaldehyde condensate, and a salt of an alkyl naphthalene sulfonate. The fluorochemical compound has the formula

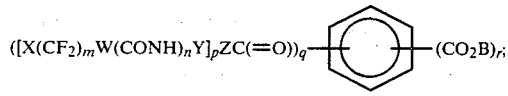

wherein the attachment of the fluorinated radicals and the radicals $CO_2B$ to the nucleus is in asymmetrical positions with respect to rotation about the axis through the center of the nucleus; wherein "X" is fluorine, or perfluoroalkoxy of 1 to 6 carbon atoms, and m has arithmetic mean between 2 and 20; n is zero or unity; "W" and "Y" are alkylene, cycloalkylene or alkyleneoxy radicals of combined chain length from 2 to 20 atoms; $(CF_2)_m$ and "Y" have each at least 2 carbon atoms in the main chain; "Z" is oxygen and p is 1, or "Z" is nitrogen and p is 2; q is an integer of at least 2 but not greater than 5; "B" is $CH_2RCHOH$ or is $CH_2RCHOCH_2RCHOH$ where "R" is hydrogen or methyl, or "B" is $CH_2CH(OH)CH_2Q$ where Q is halogen, hydroxy, or nitrile; or "B" is $CH_2CH(OH)CH_2OCH_2CH(OH)CH_2Q$; and r is an integer of at least 1 but not greater than q; and $X(CF_2)_m$, W and Y are straight chains, branched chains or cyclic; and wherein the substituent chains of the above general formulas are the same or different.

The solution forming a part of the yarn finish composition preferably consists essentially of about 40 to 90 percent by weight of a salt of dioctylsulfosuccinate, about 5 to 30 percent by weight of propylene glycol, and about 5 to 30 percent by weight of water.

The preferred dispersant is the salt, preferably sodium salt, of a polycarboxylic acid having about 5 to 8 units in the polymer chain and an average molecular weight of 1680 with a range of 1000 to 2400. This dispersant preferably comprises about 0.20 to 3.3 weight percent of the yarn finish composition or first noncontinuous phase, and may be added, e.g., (1) in aqueous solution having a solids content of about 25 percent, a 10 percent solution of the salt having a pH of about 10.0, or (2) in aqueous solution having a solids content of about 30 percent, a 10 percent solution of the salt having a pH of about 9.8.

An alternate dispersant is the salt, preferably sodium salt, of a sulfonated naphthalene-formaldehyde condensate having an estimated molecular weight of 666. This dispersant preferably comprises about 0.77 to 2.4 weight percent of the yarn finish composition or first noncontinuous phase, and may be added, e.g., (1) in free flowing granular form having a solids content of about 95 percent, a 2 percent aqueous solution of the salt having a pH of about 10.0, or (2) in free flowing powder form having a solids content of about 93 percent, a 2 percent aqueous solution of the salt having a pH of about 9.4.

Another satisfactory dispersant is the salt, preferably the sodium salt, of an alkyl, preferably dimethyl, naphthalene sulfonate; this dispersant preferably comprises about 1.64 weight percent of the yarn finish composition or first noncontinuous phase.

It is preferred that the oil in water emulsion of the present invention comprise approximately 1.5 to 25 percent by weight of the composition. The emulsion can be applied in any known manner to synthetic organic polymer fiber, yarn, or yarn products, e.g., with the standard rotating wetted wheel applicator, slot applicator, metering applicator, by spraying the fiber, yarn or yarn products or by dipping them into or otherwise contacting them with the emulsion. See, for example, U.S. Pat. No. 4,192,754 to Marshall et al.

The spin finishes of the present invention comprise a first noncontinuous phase, water and a second noncontinuous phase. The first noncontinuous phase comprises the yarn finish composition as defined above. The second noncontinuous phase is preferably an emulsion, optionally aqueous, which must be capable of being emulsified with the first noncontinuous phase and water without separation of any of the component parts of the spin finish.

The minimum acceptable percentage by weight for the spin finish of the first noncontinuous phase is believed to depend on the maximum temperature measured on the yarn and/or yarn product in processing subsequent to application of the spin finish. For high temperature processing, the spin finish of the present invention comprises about 1.5 to 25 percent, more preferably about 2.4 to 10 percent, by weight of the first noncontinuous phase; about 50 to 96 percent, more preferably about 80 to 93 percent by weight of water; and about 2.5 to 25 percent, more preferably about 5 to 15 percent, by weight of a second noncontinuous phase. By "high temperature" is meant that the yarn and/or yarn product temperature exposure is in excess of 110° C., preferably in the range of about 140° C. to 180° C. Since very little of this spin finish flashes off in high temperature processing, about 0.2 to 1.5 percent by weight of yarn, of oil, is applied as spin finish, and about 0.18 to 1.35 percent by weight of yarn, of oil, remains on the yarn after high temperature processing. A minimum of about 0.075 percent by weight of yarn, of the fluorochemical compound, after high temperature processing of the yarn has been found to provide effective oil repellency and resistance to soiling, especially by oily materials. The most preferred second noncontinuous phase of the spin finish consists essentially of about 20 to 70 percent by weight of coconut oil, about 10 to 50 percent by weight of polyoxyethylene oleyl ether containing about 5 to 20 moles of ethylene oxide per mole of oleyl alcohol, and about 5 to 30 percent by weight of polyoxyethylene stearate containing about 4 to 15 moles of ethylene oxide per mole of stearic acid. For other acceptable second noncontinuous phases refer to U.S. Pat. No. 4,192,754 to Marshall et al., and U.S. Application Ser. No. 102,588 filed Dec. 12, 1979.

For low temperature processing, the spin finish of the present invention comprises about 2.6 to 25 percent, more preferably about 3.8 to 10 percent by weight of the first noncontinuous phase; about 50 to 95 percent, more preferably about 80 to 92 percent by weight of water; and about 2.5 to 25 percent, more preferably about 5 to 15 percent, by weight of a second noncontinuous phase. By "low temperature" is meant that the yarn and/or yarn product temperature exposure is about 110° C. or less, preferably in the range of about 100° C. to 110° C. About 0.2 to 1.5 percent by weight of yarn, of oil, is preferably applied as spin finish, and about 0.19 to 1.4 percent by weight of yarn, of oil, remains on the yarn after low temperature processing. As little as about 0.12 percent by weight of yarn, of the fluorochemical compound, after low temperature processing of the yarn has been found to provide effective oil repellency and resistance to soiling, especially by oily materials. The second noncontinuous phases disclosed above as suitable for use in the spin finishes for high temperature processing are also suitable for use in the present spin finish.

This invention includes also polyamide and polyester and other synthetic polymer fibers, yarns and yarn products having incorporated therewith the yarn composition, emulsion or spin finishes as above defined.

The spin finishes of the present invention, in addition to rendering yarn treated therewith oil repellent and resistant to soiling, provide lubrication, static protection and plasticity to the yarn for subsequent operations, such as drawing and steam jet texturing and other operations for production of bulked yarn, particularly bulked carpet yarn or textured apparel yarn.

Throughout the present specification and claims the terms "yarn", "yarn product", "synthetic organic polymer" and "during commercial processing of the yarn" are as defined in U.S. Pat. No. 4,192,754 to Marshall et al.

DESCRIPTION OF THE PREFERRED EMBODIMENT

The preferred fluorochemical compounds which are useful in the yarn finish composition, emulsion and spin finishes of the present invention are as described in the preferred embodiment of U.S. Pat. No. 4,192,754 to Marshall et al., hereby incorporated by reference.

The invention will now be further described in the following specific examples which are to be regarded solely as illustrative and not as restricting the scope of the invention. In particular, although the examples are limited to polyamide and polyester yarns and yarn products, it will be appreciated that the yarn finish composition, emulsion and spin finishes of the present invention can be applied to yarn made from any synthetic organic polymer filaments and products thereof. Further, although the examples are limited to sodium dioctyl sulfosuccinate, the dioctyl sulfosuccinates useful in this invention are of the salts of dioctyl sulfosuccinates, especially the ammonium salt and the alkali metal, particularly sodium and potassium, salts of a dioctyl ester of sulfosuccinic acid; similarly, with respect to the salt of a polycarboxylic acid, the salt of a sulfonated naphthalene-formaldehyde condensate, and the salt of an alkyl naphthalene sulfonate. In the following examples, parts and percentages employed are by weight unless otherwise indicated.

EXAMPLE 1

The fluorochemical used in this example was a mixture of pyromellitates having the following structure:

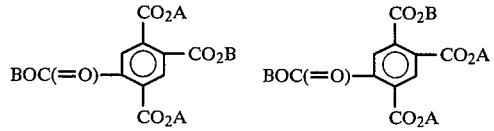

(a) para (50%) (b) meta (50%)

A = $(CH_2)_2(CF_2)_nCF_3$ where n is 5–13;
B = $CH_2CHOHCH_2Cl$.

For convenience, this mixture of pyromellitates is hereinafter called Fluorochemical Composition-1. About 40 parts of Fluorochemical Composition-1 were added to 20 parts of a solution which consisted essentially of about 70 percent by weight of sodium dioctyl sulfosuccinate, about 16 percent by weight of propylene glycol and about 14 percent by weight of water. This solution is manufactured under the trade name of Aerosol OT-70-PG and obtainable from the American Cyanamid Company, Industrial Chemical Division, Process Chemicals Department, Wayne, N.J. 07470. The Fluorochemical Composition-1 and solution were heated to 90° C. at which temperature the Fluorochemical Composition-1 melted and formed a clear homogeneous first noncontinuous phase. The first noncontinuous phase was then added to 860 parts of water heated to about 90° C., and the mixture was agitated to form an emulsion, which was then cooled to about 60° C. The oil particles of this emulsion had a particle size of less than 1 micron. For convenience, this emulsion is called Emulsion-R (see Table I) and is the control. Emulsion-R was visually inspected for degree of settlement and given a rating of 1 on a scale from 0 to 5 wherein 0 represented the highest degree of settlement and 5 represented no settlement.

It should be noted that in forming Emulsion-R or the first noncontinuous phase above, Fluorochemical Composition-1 and the solution can be heated to a temperature of between approximately 80° C. and 95° C. The temperature of the water should correspond approximately to that of the first noncontinuous phase when it is added to the water. The resultant emulsion can be cooled to a temperature between approximately 50° C. and 85° C.

Several dispersants were similarly evaluated after incorporating them one at a time (in the amounts shown in Table I) into Emulsion-R as follows: The Fluorochemical Composition-1 was added to the solution and a dispersant simultaneously, and all were heated to 90° C. at which temperature the Fluorochemical Composition-1 melted and formed a clear homogeneous first noncontinuous phase. This first noncontinuous phase was then added to 860 parts of water heated to about 90° C., and the mixture was agitated to form an emulsion, which was then cooled to about 60° C. The oil particles in these emulsions had a particle size of less than 1 micron. See Table I for evaluations of the dispersants.

EXAMPLE 2 (COMPARATIVE)

The procedure of Example 1 was repeated to produce another control emulsion, except that 878 parts of water were utilized. To this emulsion was added 62 parts of a second noncontinuous phase consisting essentially of about 50 percent by weight of coconut oil, about 30 percent by weight of polyoxyethylene oleyl ether containing about 10 moles of ethylene oxide per mole of oleyl alcohol, and about 20 percent by weight of polyoxyethylene stearate containing about 8 moles of ethylene oxide per mole of stearic acid. After 24 hours settlement was observed in the bottom of the container in which this spin finish had been placed.

EXAMPLE 3

The procedure of Example 1 was repeated to produce another emulsion similar to Emulsion-K (Table I) except that 872 parts of water were utilized. To this emulsion was added 62 parts of a second noncontinuous phase consisting essentially of about 50 percent by weight of coconut oil, about 30 percent by weight of polyoxyethylene oleyl ether containing about 10 moles of ethylene oxide per mole of oleyl alcohol, and about 20 percent by weight of polyoxyethylene stearate containing about 8 moles of ethylene oxide per mole of stearic acid. After 24 hours there was no settlement observed in the bottom of the container in which this spin finish had been placed.

EXAMPLES 4–13

These examples demonstrate the use of Emulsion-A and Emulsions E-M from Table I as spin finishes (when combined with a second noncontinuous phase as in Example 3) in a conventional spin-draw high temperature process for production of a polyamide yarn suitable for processing into bulked yarn that is oil-repellent and resistant to soiling especially by oily materials. The procedure of Example 3 in U.S. Pat. No. 4,192,754 to Marshall et al. is followed with the substitution of the spin finishes which include Emulsion-A and Emulsions E-M in, respectively, Examples 4–13, for the spin finish of that example. The spin finishes are applied to the yarn at a wet pickup sufficient to achieve about 0.16 percent by weight of yarn, of the fluorochemical compound, on the yarn after high temperature processing. Bulked yarn made in accordance with each of these examples has an acceptable mechanical quality rating. Fabric made from polyamide yarn prepared in accordance with each of the present examples has an acceptable oil repellency.

EXAMPLES 14–23

Polycaproamide polymer having about 27±1 amine end groups and about 20 carboxyl end groups, a formic acid viscosity of about 55±2.0 and an extractables level of less than about 2.8 percent, is supplied at a rate of about 125 pounds per hour per spinnerette (250 pounds per hour per position) to a spinning position which comprises two spin pots each containing one spinnerette. Each spinnerette has 300 Y-shaped orifices. The filaments are extruded from each spinnerette into a quench stack for cross-flow quenching. Each end of quenched filaments has one of the spin finishes of Examples 4–13 applied in, respectively, Examples 14–23, at about 4.8 to 5 percent wet pickup and subsequently is deposited in a tow can. The undrawn denier per filament of the yarn is about 50, and the modification ratio is between about 2.9 to 3.4. Subsequently, yarn from several tow cans is combined in a creel into a tow and is stretched in a normal manner at a stretch ratio of about 2.9 in a tow stretcher. The tow is then fed through a stuffing box crimper using 10 pounds of steam to produce about 11 crimps per inch and deposited in an autoclave cart for batch crimp setting at about 107° to 113° C. (225° to 235° F.). At the end of the autoclave cycle, the tow is fed into a conventional cutter, is cut into staple yarn, has a lubricating overfinish applied (Quadralube 7A, Manufacturers Chemicals Corporation, P.O. Box 197, Cleveland, Tenn. 37311), and is baled. It is believed that the maximum temperature exposure measured on the yarn would be 110° C. or less; in this regard, the above-described process is deemed "low temperature".

In the finish circulation system, a finish circulating pump pumps the spin finish from the supply tank into a tray in which a kiss roll turns to pick up finish for application to the moving yarn in contact with the kiss roll. Finish from the tray overflows into the supply tank.

The cut staple yarn is made into a carpet by conventional means and is evaluated for oil repellency by AATCC Test No. 118-1975 as outlined in Example 3 of U.S. Pat. No. 4,192,754 to Marshall et al. The carpet made from polyamide yarn prepared in accordance with each of the present examples has an acceptable oil repellency.

EXAMPLES 24–33

Polyethylene terephthalate pellets are melted at about 290° C. and are melt extruded under a pressure of about 2500 psig. through a 34-orifice spinnerette to produce a partially oriented yarn having about 250 denier. The spin finishes of Examples 4–13 are applied to the yarn in, respectively, Examples 24–33, via a kiss roll in amount to provide about 0.6 percent by weight of oil on the yarn. The yarn is then draw-textured at about 1.3 times the extruded length and at a temperature of 150° to 175° C. to produce a bulked yarn having a drawn denier of about 150. Yarn produced in this manner is particularly useful for production of carpets and fine apparel. Bulked yarn made in accordance with these examples has an acceptable mechanical quality rating. Fabric made from yarn prepared in accordance with each of the present examples has an acceptable oil repellency.

DISCUSSION

With reference to Table I, the emulsions which performed better than Control Emulsion-R, specifically Emulsions A and E through M, form the present invention, as well as spin finishes formulated therefrom. The yarn finish composition, emulsions and spin finishes of the present invention exhibit exceptional emulsion stability and do not cause fluorocarbon deposits in the finish feed lines to the extent of the prior art.

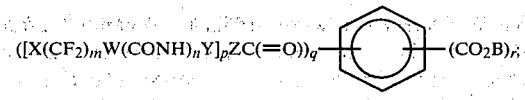

TABLE I

EMULSION STABILITY DATA

| Component** | A | B | C | D | E | F | G | H | I |
|---|---|---|---|---|---|---|---|---|---|
| | Formulation by Parts* | | | | | | | | |
| 1 | 40 | 40 | 40 | 40 | 40 | 40 | 40 | 40 | 40 |
| 2 | 20 | 20 | 20 | 20 | 20 | 20 | 20 | 20 | 20 |
| 3 | 1.0 | 0.5 | 2.0 | — | — | — | — | — | — |
| 4 | — | — | — | — | 1.0 (0.95) | 0.5 (0.48) | — | — | — |
| 5 | — | — | — | — | — | — | 1.0 (0.93) | 0.5 (0.47) | — |
| 6 | — | — | — | — | — | — | — | — | 2.0 (0.50) |
| 7 | — | — | — | — | — | — | — | — | — |
| 8 | — | — | — | — | — | — | — | — | — |
| 9 | — | — | — | — | — | — | — | — | — |
| 10 | — | — | — | 1.0 | — | — | — | — | — |
| 11 | 860 | 860 | 860 | 860 | 860 | 860 | 860 | 860 | 860 |
| Rating | 2 | 1 | 1 | 0 | 3 | 3 | 2 | 2 | 3 |

| Component** | J | K | L | M | N | O | P | Q | R |
|---|---|---|---|---|---|---|---|---|---|
| | Formulation by Parts* | | | | | | | | |
| 1 | 40 | 40 | 40 | 40 | 40 | 40 | 40 | 40 | 40 |
| 2 | 20 | 20 | 20 | 20 | 20 | 20 | 20 | 20 | 20 |
| 3 | — | — | — | — | — | — | — | — | — |
| 4 | — | — | — | — | — | — | — | — | — |
| 5 | — | — | — | — | — | — | — | — | — |
| 6 | 4.0 (1.0) | 6.0 (1.5) | — | — | — | — | — | — | — |
| 7 | — | — | 1.0 (0.30) | 0.5 (0.15) | — | — | — | — | — |
| 8 | — | — | — | — | 2.0 | 3.0 | — | — | — |
| 9 | — | — | — | — | — | — | 0.1 | 0.4 | — |
| 10 | — | — | — | — | — | — | — | — | — |
| 11 | 860 | 860 | 860 | 860 | 860 | 860 | 860 | 860 | 860 |
| Rating | 4 | 5 | 2 | 2 | 1 | 1 | 0 | 0 | 1 |

*Solids content by parts indicated parenthetically where applicable.
**Number corresponds to footnote.

Footnotes to Table I.

1 Fluorochemical Composition-1.
2 AEROSOL OT-70-PG. American Cyanamid's trade name for solution consisting essentially of about 70 percent by weight of sodium dioctyl sulfosuccinate, about 16 percent by weight of propylene glycol and about 14 percent by weight of water.
3 PETRO AG. Alkyl naphthalene sodium sulfonate (dimethyl) supplied by Petro Chemical Co., Inc.
4 TAMOL N. Rohm & Haas Company's trade name for the sodium salt of a sulfonated naphthalene-formaldehyde condensate in free flowing granular form which has a solids content of 95% and a pH of 10.0 (2% aqueous solution). The estimated molecular weight is 666.
5 TAMOL SN. Rohm & Haas Company's trade name for the sodium salt of a sulfonated naphthalene-formaldehyde condensate in free flowing powder form which has a solids content of 93% and a pH of 9.4 (2% aqueous solution). The estimated molecular weight is 666.
6 TAMOL 731-25%. Rohm & Haas Company's trade name for the sodium salt of a polycarboxylic acid in aqueous solution having a solids content of 25% and a pH of 10.0 (10% aqueous solution). There are about 5 to 8 units in the polymer chain, and the average molecular weight is about 1680 with a range of from 1000 to 2400.
7 TAMOL 850. Rohm & Haas Company's trade name for the sodium salt of a polycarboxylic acid in aqueous solution having a solids content of 30% and a pH of 9.8 (10% aqueous solution). There are about 5 to 8 units in the polymer chain, and the average molecular weight is about 1680 with a range of from 1000 to 2400.
8 Sipex SB. Sodium lauryl sulfate (29% active in water) supplied by Alcolac, Inc.
9 FC-143. Ammonium perfluoroalkyl carboxylate supplied by Minnesota Mining and Manufacturing Company.
10 Monolube 2978. Cocoalkanol amide supplied by Mono Industries, Inc.
11 Water.

What is claimed is:

1. A yarn finish composition comprising:

a. about 15 to 80 weight percent of a solution of a salt of dioctyl sulfosuccinate, propylene glycol and water;

b. about 20 to 85 weight percent of a fluorochemical compound having the formula:

wherein the attachment of the fluorinated radicals and the radicals $CO_2B$ to the nucleus is in asymmetrical positions with respect to rotation about the axis through the center of the nucleus; wherein "X" is fluorine, or perfluoroalkoxy of 1 to 6 carbon atoms, and m has arithmetic mean between 2 and 20; n is zero or unity; "W" and "Y" are alkylene, cycloalkylene or alkyleneoxy radicals of combined chain length from 2 to 20 atoms; $(CF_2)_m$ and "Y"

have each at least 2 carbon atoms in the main chain, "Z" is oxygen and p is 1, or "Z" is nitrogen and p is 2; q is an integer of at least 2 but not greater than 5; "B" is $CH_2RCHOH$ or is $CH_2RCHOCH_2RCHOH$ where "R" is hydrogen or methyl, or "B" is $CH_2CH(OH)CH_2Q$ where Q is halogen, hydroxy, or nitrile; or "B" is $CH_2CH(OH)CH_2OCH_2CH(OH)CH_2Q$; and r is an integer of at least 1 but not greater than q; and $X(CF_2)_m$, W and Y are stright chains, branched chains or cyclic; and wherein the substituent chains of the above general formulas are the same or different; and c. an effective amount of a dispersant selected from the group consisting of a salt of a polycarboxylic acid, a salt of a sulfonated naphthalene-formaldehyde condensate, and a salt of an alkyl naphthalene sulfonate.

2. A polyamide yarn having incorporated therewith the composition of claim 1.

3. A polyester yarn having incorporated therewith the composition of claim 1.

4. The polyamide yarn product having incorporated therewith the composition of claim 1.

5. The polyester yarn product having incorporated therewith the composition of claim 1.

6. The yarn finish composition of claim 1 wherein the dispersant is the salt of a polycarboxylic acid having 5 to 8 units in the polymer chain and an average molecular weight of 1680, said salt of a polycarboxylic acid being added in aqueous solution having a solids content of about 25 percent, a 10 percent aqueous solution of said salt having a pH of about 10.0.

7. The yarn finish composition of claim 6 wherein the dispersant comprises about 0.20 to 3.3 weight percent of said yarn finish composition.

8. A polyamide yarn having incorporated therewith the composition of claim 7.

9. A polyester yarn having incorporated therewith the composition of claim 7.

10. The polyamide yarn product having incorporated therewith the composition of claim 7.

11. The polyester yarn product having incorporated therewith the composition of claim 7.

12. The yarn finish composition of claim 1 wherein the dispersant is the salt of a polycarboxylic acid having 5 to 8 units in the polymer chain and an average molecular weight of 1680, said salt of a polycarboxylic acid being added in aqueous solution having a solids content of about 30 percent, a 10 percent aqueous solution of said salt having a pH of about 9.8.

13. The yarn finish composition of claim 12 wherein the dispersant comprises about 0.20 to 3.3 weight percent of said yarn finish composition.

14. The yarn finish composition of claim 1 wherein the dispersant is the salt of a sulfonated naphthalene-formaldehyde condensate added in free flowing granular form having a solids content of about 95 percent, a 2 percent aqueous solution of said salt having a pH of about 10.0.

15. The yarn finish composition of claim 14 wherein the dispersant comprises about 0.77 to 2.4 weight percent of said yarn finish composition.

16. The yarn finish composition of claim 1 wherein the dispersant is a salt of a sulfonated naphthalene-formaldehyde condensate added in free flowing powder form having a solids content of about 93 percent, a 2 percent aqueous solution of said salt having a pH of about 9.4.

17. The yarn finish composition of claim 16 wherein the dispersant comprises about 0.77 to 2.4 weight percent of said yarn finish composition.

18. The yarn finish composition of claim 1 wherein the dispersant is the salt of an alkyl naphthalene sulfonate.

19. The yarn finish composition of claim 18 wherein the dispersant comprises about 1.64 weight percent of said yarn finish composition.

20. An emulsion comprising:

a. approximately 75 to 98.5 weight percent of water; and b. approximately 1.5 to 25 weight percent of the yarn finish composition of claim 1.

21. A spin finish for yarn, made from synthetic organic polymer, to be processed at high temperature into a yarn that is oil repellent and resistant to soiling, said spin finish comprising:

a. about 1.5 to 25 percent by weight of said spin finish of a first noncontinuous phase comprising i. about 15 to 80 weight percent of a solution of a salt of dioctyl sulfosuccinate, propylene glycol and water, and ii. about 20 to 85 weight percent of a fluorochemical compound having the formula

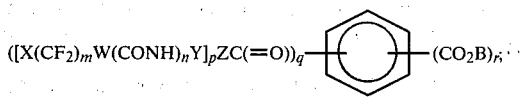

wherein the attachment of the fluorinated radicals and the radicals $CO_2B$ to the nucleus is in asymmetrical positions with respect to rotation about the axis through the center of the nucleus; wherein "X" is fluorine, or perfluoroalkoxy of 1 to 6 carbon atoms, and m has arithmetic mean between 2 and 20; n is zero or unity; "W" and "Y" are alkylene, cycloalkylene or alkyleneoxy radicals of combined chain length from 2 to 20 atoms; $(CF_2)_m$ and "Y" have each at least 2 carbon atoms in the main chain; "Z" is oxygen and p is 1, or "Z" is nitrogen and p is 2; q is an integer of at least 2 but not greater than 5; "B" is $CH_2RCHOH$ or is $CH_2RCHOCH_2RCHOH$ where "R" is hydrogen or methyl, or "B" is $CH_2CH(OH)CH_2Q$ where Q is halogen, hydroxy, or nitrile; or "B" is $CH_2CH(OH)CH_2OCH_2CH(OH)CH_2Q$; and r is an integer of at least 1 but not greater than q; and $X(CF_2)_m$, W and Y are straight chains, branched chains or cyclic; and wherein the substituent chains of the above general formulas are the sam or different; and iii. an effective amount of said first noncontinuous phase of a dispersant chosen from the group consisting of a salt of a polycarboxylic acid, a salt of a sulfonated naphthalene-formaldehyde condensate, and a salt of an alkyl naphthalene sulfonate;

b. about 50 to 96 percent by weight of said spin finish of water; and c. about 2.5 to 25 percent by weight of said spin finish of a second noncontinuous phase which is capable of being emulsified with said first noncontinuous phase and said water without separation of any of the component parts of said spin finish.

22. The spin finish of claim 21 wherein the fluorochemical compound is a trimellitate, a pyromellitate, or a bis(diamide)/ester of a trimellitic acid or of pyromellitic acid, wherein each fluorinated radical, of formula $X(CF_2)_mW(CONH)_nY$, has a main chain containing at least six carbon atoms and contains at least four perfluorinated carbon atoms in the radical.

23. The spin finish of claim 21 wherein the fluorochemical compound is a mixture of pyromellitates having the structure:

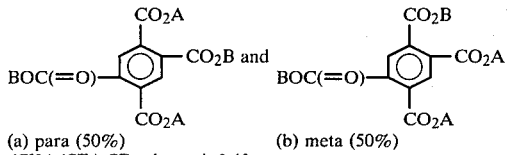

(a) para (50%) (b) meta (50%)

A = $(CH_2)_2(CF_2)_nCF_3$ where n is 5-13

B = $CH_2CHOHCH_2Cl$.

24. The spin finish of claim 21 wherein said solution consists essentially of about 40 to 90 percent by weight of the salt of dioctyl sulfosuccinate, about 5 to 30 percent by weight of propylene glycol, and about 5 to 30 percent by weight of water.

25. The spin finish of claim 21 wherein said solution consists essentially of about 70 percent by weight of the salt of dioctyl sulfosuccinate, about 16 percent by weight of propylene glycol, and about 14 percent by weight of water.

26. A polyamide yarn having incorporated therewith the composition of claim 21.

27. A polyester yarn having incorporated therewith the composition of claim 21.

28. The polyamide yarn product having incorporated therewith the composition of claim 21.

29. The polyester yarn product having incorporated therewith the composition of claim 21.

30. The spin finish of claim 21 wherein the dispersant is the salt of a polycarboxylic acid having 5 to 8 units in the polymer chain and an average molecular weight of 1680, said salt of a polycarboxylic acid being added in aqueous solution having a solids content of about 25 percent, a 10 percent aqueous solution of said salt having a pH of about 10.

31. The spin finish of claim 30 wherein the dispersant comprises about 0.20 to 3.3 weight percent of said first noncontinuous phase.

32. A polyamide yarn having incorporated therewith the composition of claim 31.

33. A polyester yarn having incorporated therewith the composition of claim 31.

34. The polyamide yarn product having incorporated therewith the composition of claim 31.

35. The polyester yarn product having incorporated therewith the composition of claim 31.

36. The spin finish of claim 21 wherein the dispersant is the salt of a polycarboxylic acid having 5 to 8 units in the polymer chain and an average molecular weight of 1680, said salt of a polycarboxylic acid being added in aqueous solution having a solids content of about 30 percent, a 10 percent aqueous solution of said salt having a pH of about 9.8.

37. The spin finish of claim 36 wherein the dispersant comprises about 0.20 to 3.3 weight percent of said first noncontinuous phase.

38. The spin finish of claim 21 wherein the dispersant is the salt of a sulfonated naphthalene-formaldehyde condensate added in free flowing granular form having a solids content of about 95 percent, a 2 percent aqueous solution of said salt having a pH of about 10.0.

39. The spin finish of claim 38 wherein the dispersant comprises about 0.77 to 2.4 weight percent of said first noncontinuous phase.

40. The spin finish of claim 21 wherein the dispersant is the salt of a sulfonated naphthalene-formaldehyde condensate added in free flowing powder form having a solids content of about 93 percent, a 2 percent solution of said salt having a pH of about 9.4.

41. The spin finish of claim 40 wherein the dispersant comprises about 0.77 to 2.4 weight percent of said first noncontinuous phase.

42. The spin finish of claim 21 wherein the dispersant is the salt of dimethyl naphthalene sulfonate.

43. The spin finish of claim 42 wherein the dispersant comprises about 1.64 weight percent of said first noncontinuous phase.

44. The spin finish of claim 1 wherein said second noncontinuous phase is selected from the group consisting of:

a. about 20 to 70 percent by weight of coconut oil, about 10 to 50 percent by weight of polyoxyethylene oleyl ether containing about 5 to 20 moles of ethylene oxide per mole of oleyl alcohol, and about 5 to 30 percent by weight of polyoxyethylene stearate containing about 4 to 15 moles of ethylene oxide per mole of stearic acid;

b. about 40 to 65 percent by weight of coconut oil, about 15 to 35 percent by weight of polyoxyethylene oleyl ether containing about 5 to 20 moles of ethylene oxide per mole of oleyl alcohol, about 2 to 10 percent by weight of polyoxyethylene nonyl phenol containing about 5 to 15 moles of ethylene oxide per mole of nonyl phenol, and about 5 to 25 percent by weight of polyoxyethylene stearate containing about 4 to 15 moles of ethylene oxide per mole of stearic acid;

c. about 40 to 65 percent by weight of coconut oil, about 15 to 35 percent by weight of polyoxyethylene oleyl ether containing about 8 to 20 moles of ethylene oxide per mole of oleyl alcohol, about 2 to 10 percent by weight of polyoxyethylene oleate containing about 2 to 7 moles of ethylene oxide per mole of oleic acid, and about 5 to 25 percent by weight of polyoxyethylene castor oil containing about 2 to 10 moles of ethylene oxide per mole of castor oil;

d. about 40 to 65 percent by weight of mineral oil, about 5 to 15 percent by weight of a fatty acid soap, about 10 to 25 percent by weight of sulfonated ester ethoxylate, about 5 to 15 percent by weight of polyethylene glycol ester, about 2 to 10 percent of weight of polyethylene glycol ether, and about 0.5 to 2 percent by weight of triethanolamine;

e. about 40 to 60 percent by weight of white mineral oil, about 40 to 60 percent by weight of sodium salt of polyoxyethylene oleyl phosphate containing about 5 to 9 moles of ethylene oxide per mole of oleyl alcohol, and about 0.5 to 4 percent by weight of a salt of dinonyl sulfosuccinate; and f. about 40 to 50 percent by weight of an alkyl stearate wherein the alkyl group contains 4 to 18 carbon atoms, about 25 to 30 percent by weight of sorbitan monooleate, and about 25 to 30 percent by weight of polyoxyethylene tallow amine containing about 18 to 22 moles of ethylene oxide per mole of tallow amine.

45. A spin finish for yarn, made from synthetic organic polymer, to be processed at low temperature into a yarn that is oil repellent and resistant to soiling, said spin finish comprising:

a. about 2.6 to 25 percent by weight of said spin finish of a first noncontinuous phase comprising i. about 15 to 80 weight percent of a solution of a salt of dioctyl sulfosuccinate, propylene glycol and water;

ii. about 20 to 85 weight percent of a fluorochemical compound having the formula

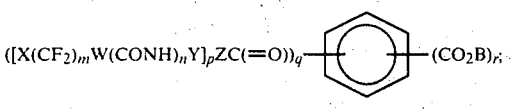

wherein the attachment of the fluorinated radicals and the radicals $CO_2B$ to the nucleus is in asymmetrical positions with respect to rotation about the axis through the center of the nucleus; wherein "X" is fluorine or perfluoroalkoxy of 1 to 6 carbon atoms, and m has arithmetic mean between 2 and 20; n is zero or unity; "W" and "Y" are alkylene, cycloalkylene or alkyleneoxy radicals of combined chain length from 2 to 20 atoms; $(CF_2)_m$ and "Y" have each at least 2 carbon atoms in the main chain; "Z" is oxygen and p is 1, or "Z" is nitrogen and p is 2; q is an integer of at least 2 but not greater than 5; "B" is $CH_2RCHOH$ or is $CH_2RCHOCH_2RCHOH$ where "R" is hydrogen or methyl, or "B" is $CH_2CH(OH)CH_2Q$ where Q is halogen, hydroxy, or nitrile; or "B" is $CH_2CH(OH)CH_2OCH_2CH(OH)CH_2Q$; and r is an integer of at least 1 but not greater than q; and $X(CF_2)_m$, W and Y are straight chains, branched chains or cyclic; and wherein the substituent chains of the above general formulas are the same or different; and iii. an effective amount of a dispersant selected from the group consisting of a salt of a polycarboxylic acid, a salt of a sulfonated naphthalene-formaldehyde condensate, and a salt of an alkyl naphthalene sulfonate;

b. about 50 to 95 percent by weight of said spin finish of water; and c. about 2.5 to 25 percent by weight of said spin finish of a second noncontinuous phase which is capable of being emulsified with said first noncontinuous phase and said water without separation of any of the component parts of said spin finish.

46. The spin finish of claim 45 wherein the fluorochemical compound is a trimellitate, a pyromellitate, or a bis(diamide)/ester of trimellitic acid or of pyromellitic acid, wherein each fluorinated radical, of formula $X(CF_2)_mW(CONH)_nY$, has a main chain containing at least six carbon atoms and contains at least four perfluorinated carbon atoms in the radical.

47. The spin finish of claim 45 wherein the fluorochemical compound is a mixture of pyromellitates having the structure:

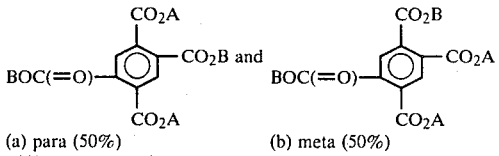

(a) para (50%) (b) meta (50%)

A = $(CH_2)_2(CF_2)_nCF_3$ where n is 5-13

B = $CH_2CHOHCH_2Cl$.

48. The spin finish of claim 45 wherein said solution consists essentially of about 40 to 90 percent by weight of the salt of dioctyl sulfosuccinate, about 5 to 30 percent by weight of propylene glycol, and about 5 to 30 percent by weight of water.

49. The spin finish of claim 45 wherein said solution consists essentially of about 70 percent by weight of the salt of dioctyl sulfosuccinate, about 16 percent by weight of propylene glycol, and about 14 percent by weight of water.

50. A polyamide yarn having incorporated therewith the composition of claim 45.

51. A polyester yarn having incorporated therewith the composition of claim 45.

52. The polyamide yarn product having incorporated therewith the composition of claim 45.

53. The polyester yarn product having incorporated therewith the composition of claim 45.

54. The spin finish of claim 45 wherein the dispersant is the salt of a polycarboxylic acid having 5 to 8 units in the polymer chain and an average molecular weight of 1680, said salt of a polycarboxylic acid being added in aqueous solution having a solids content of about 25 percent, a 10 percent aqueous solution of said salt having a pH of about 10.0.

55. The spin finish of claim 54 wherein the dispersant comprises about 0.20 to 3.3 weight percent of said first noncontinuous phase.

56. A polyamide yarn having incorporated therewith the composition of claim 55.

57. A polyester yarn having incorporated therewith the composition of claim 55.

58. The polyamide yarn product having incorporated therewith the composition of claim 55.

59. The polyester yarn product having incorporated therewith the composition of claim 55.

60. The spin finish of claim 45 wherein the dispersant is the salt of a polycarboxylic acid having 5 to 8 units in the polymer chain and an average molecular weight of 1680, said salt of a polycarboxylic acid being added in aqueous solution having a solids content of about 30 percent, a 10 percent aqueous solution of said salt having a pH of about 9.8.

61. The spin finish of claim 60 wherein the dispersant comprises about 0.20 to 3.3 weight percent of said first noncontinuous phase.

62. The spin finish of claim 45 wherein the dispersant is the salt of a sulfonated naphthaleneformaldehyde condensate added in free flowing granular form having a solids content of about 95 percent, a 2 percent aqueous solution of said salt having a pH of about 10.0.

63. The spin finish of claim 62 wherein the dispersant comprises about 0.77 to 2.4 weight percent of said first noncontinuous phase.

64. The spin finish of claim 45 wherein the dispersant is the salt of a sulfonated naphthalene-formaldehyde condensate added in free flowing powder form having a solids content of about 93 percent, a 2 percent aqueous solution of said salt having a pH of about 9.4.

65. The spin finish of claim 64 wherein the dispersant comprises about 0.77 to 2.4 weight percent of said first noncontinuous phase.

66. The spin finish of claim 45 wherein the dispersant is the salt of dimethyl naphthalene sulfonate.

67. The spin finish of claim 66 wherein the dispersant comprises about 1.64 weight percent of said first noncontinuous phase.

68. The spin finish of claim 21 wherein said second noncontinuous phase is selected from the group consisting of:

a. about 20 to 70 percent by weight of coconut oil, about 10 to 50 percent by weight of polyoxyethylene oleyl ether containing about 5 to 20 moles of ethylene oxide per mole of oleyl alcohol, and about 5 to 30 percent by weight of polyoxyethylene stearate containing about 4 to 15 moles of ethylene oxide per mole of stearic acid;

b. about 40 to 65 percent by weight of coconut oil, about 15 to 35 percent by weight of polyoxyethylene oleyl ether containing about 5 to 20 moles of ethylene oxide per mole of oleyl alcohol, about 2 to 10 percent by weight of polyoxyethylene nonyl phenol containing about 5 to 15 moles of ethylene oxide per mole of nonyl phenol, and about 5 to 25 percent by weight of polyoxyethylene stearate containing about 4 to 15 moles of ethylene oxide per mole of stearic acid;

c. about 40 to 65 percent by weight of coconut oil, about 15 to 35 percent by weight of polyoxyethylene oleyl ether containing about 8 to 20 moles of ethylene oxide per mole of oleyl alcohol, about 2 to 10 percent by weight of polyoxyethylene oleate containing about 2 to 7 moles of ethylene oxide per mole of oleic acid, and about 5 to 25 percent by weight of polyoxyethylene castor oil containing about 2 to 10 moles of ethylene oxide per mole of castor oil;

d. about 40 to 65 percent by weight of mineral oil, about 5 to 15 percent by weight of a fatty acid soap, about 10 to 25 percent by weight of sulfonated ester ethoxylate, about 5 to 15 percent by weight of polyethylene glycol ester, about 2 to 10 percent by weight of polyethylene glycol ether, and about 0.5 to 2 percent by weight of triethanolamine;

e. about 40 to 60 percent by weight of white mineral oil, about 40 to 60 percent by weight of sodium salt of polyoxyethylene oleyl phosphate containing about 5 to 9 moles of ethylene oxide per mole of oleyl alcohol, and about 0.5 to 4 percent by weight of a salt of dinonyl sulfosuccinate; and f. about 40 to 50 percent by weight of an alkyl stearate wherein the alkyl group contains 4 to 18 carbon atoms, about 25 to 30 percent by weight of sorbitan monooleate, and about 25 to 30 percent by weight of polyoxyethylene tallow amine containing about 18 to 22 moles of ethylene oxide per mole of tallow amine.

* * * * *

UNITED STATES PATENT AND TRADEMARK OFFICE

CERTIFICATE OF CORRECTION

PATENT NO. : 4,317,736

DATED : March 2, 1982

INVENTOR(S) : Robert Moore Marshall

It is certified that error appears in the above-identified patent and that said Letters Patent are hereby corrected as shown below:

The claims commencing with 44 are incorrectly numbered and should be corrected as follows:

In the first line of claim 44, "44" should read --68-- and "1" should read --44--.

In the first line of claim 45, "45" should read --44--.

In the first line of claim 46, "46" should read --45-- and "45" should read --44--.

In the first line of claim 47, "47" should read --46-- and "45" should read --44--.

In the first line of claim 48, "48" should read --47-- and "45" should read --44--.

In the first line of claim 49, "49" should read --48-- and "45" should read --44--.

In the first line of claim 50, "50" should read --49-- and in the second line, "45" should read --44--.

In claim 51, "51" should read --50--, and in the second line, "45" should read --44--.

In claim 52, "52" should read --51--, and in the second line, "45" should read --44--.

In claim 53, "53" should read --52--, and in the second line, "45" should read --44--.

In the first line of claim 54, "54" should read --53-- and "45" should read --44--.

UNITED STATES PATENT AND TRADEMARK OFFICE

CERTIFICATE OF CORRECTION

PATENT NO. : 4,317,736

DATED : March 2, 1982

INVENTOR(S) : Robert Moore Marshall

It is certified that error appears in the above-identified patent and that said Letters Patent are hereby corrected as shown below:

In the first line of claim 55, "55" should read --54-- and "54" should read --53--.

In claim 56, "56" should read --55--, and in the second line "55" should read --54--.

In claim 57, "57" should read --56--, and in the second line, "55" should read --54--.

In claim 58, "58" should read --57--, and in the second line, "55" should read --54--.

In claim 59, "59" should read --58--, and in the second line, "55" should read --54--.

In the first line of claim 60, "60" should read --59-- and "45" should read --44--.

In the first line of claim 61, "61" should read --60-- and "60" should read --59--.

In the first line of claim 62, "62" should read --61-- and "45" should read --44--.

In the first line of claim 63, "63" should read --62-- and "62" should read --61--.

In the first line of claim 64, "64" should read --63-- and "45" should read --44--.

In the first line of claim 65, "65" should read --64-- and "64" should read --63--.

UNITED STATES PATENT AND TRADEMARK OFFICE

CERTIFICATE OF CORRECTION

PATENT NO. : 4,317,736

DATED : March 2, 1982

INVENTOR(S) : Robert Moore Marshall

It is certified that error appears in the above-identified patent and that said Letters Patent are hereby corrected as shown below:

In the first line of claim 66, "66" should read --65-- and "45" should read --44--.

In the first line of claim 67, "67" should read --66-- and "66" should read --65--.

In claim 68, "68" should read --67--.

Signed and Sealed this

*Eleventh* Day of *January 1983*

[SEAL]

*Attest:*

GERALD J. MOSSINGHOFF

*Attesting Officer*

*Commissioner of Patents and Trademarks*